United States Patent [19]

Rado

[11] 4,313,819

[45] Feb. 2, 1982

[54] PROCESS FOR RECOVERING DEASHING SOLVENT FROM INSOLUBLE COAL PRODUCTS

[75] Inventor: Theodore A. Rado, Oklahoma City, Okla.

[73] Assignee: Kerr-McGee Corporation, Oklahoma City, Okla.

[21] Appl. No.: 152,422

[22] Filed: May 22, 1980

[51] Int. Cl.[3] ..... C10G 1/00

[52] U.S. Cl. ..... 208/177; 208/8 LE

[58] Field of Search ..... 208/8 LE, 10, 177, 361

[56] References Cited

U.S. PATENT DOCUMENTS

| | | | |
|---|---|---|---|
| 3,607,716 | 9/1971 | Roach | 208/8 |
| 3,607,717 | 9/1971 | Roach | 208/8 |
| 3,784,466 | 1/1974 | Arnold et al. | 208/361 |
| 4,040,958 | 8/1977 | Rammler | 210/73 R |
| 4,070,267 | 1/1978 | Leonard | 208/8 |
| 4,070,268 | 1/1978 | Davis et al. | 208/8 |
| 4,119,524 | 10/1978 | Leonard et al. | 208/8 |
| 4,162,956 | 7/1979 | Rhodes | 208/8 LE |
| 4,162,958 | 7/1979 | Baldwin | 208/8 LE |
| 4,164,466 | 8/1979 | Baldwin | 208/177 |
| 4,177,135 | 12/1979 | Rhodes | 208/177 |

*Primary Examiner*—Delbert E. Gantz
*Assistant Examiner*—William Leader
*Attorney, Agent, or Firm*—William G. Addison

[57] ABSTRACT

A process for effecting deashing solvent recovery from insoluble coal products and preparing a slurry of the insoluble products. An elevated temperature and pressure stream comprising insoluble coal products and deashing solvent is admixed with a makeup liquid to dilute the stream. The diluted stream is reduced in pressure and introduced into a first treatment vessel containing sufficient slurry to provide a hydrostatic pressure to prevent boiling of the diluted stream upon entry therein. The solvent then is permitted to flash and cool the remainder of the slurry. A portion of the cooled slurry is recycled to provide the makeup liquid and a second portion is introduced into a second treatment vessel to permit diffusion of solvent infused into the insoluble coal products in the slurry. The slurry of insoluble coal products in the second vessel then is introduced into a thickener to concentrate the slurry and provide a feed suitable for a gasifier.

10 Claims, 2 Drawing Figures

PROCESS FOR RECOVERING DEASHING SOLVENT FROM INSOLUBLE COAL PRODUCTS

BACKGROUND OF THE INVENTION

1. Field of the Invention

This invention relates to a process for recovering deashing solvent from insoluble coal products and preparing a slurry of the insoluble coal products for use as, for example, feed to a gasifier.

2. Brief Description of the Prior Art

Numerous processes have been developed to separate the products of coal liquefaction into fractions comprising soluble coal products and insoluble coal products when treated with one or more solvents. Some of the processes provide provision for recovering and recycling the solvents.

In U.S. Pat. No. 3,607,716 and U.S. Pat. No. 3,607,717, there are disclosed processes in which coal liquefaction products are admixed with certain light organic solvents to effect a separation of soluble coal products from the insoluble coal products. The process sometimes is referred to as a "deashing" process. The mixture of coal liquefaction products and solvent is introduced into a separation zone maintained at an elevated temperature and pressure. The mixture separates into a light phase comprising soluble coal products and solvent and a heavy phase comprising insoluble coal products and some solvent. The separated heavy phase has a viscosity under the conditions of operation whereby it is easily flowable for removal from the separation zone through a withdrawal conduit.

In U.S. Pat. No. 4,070,267, U.S. Pat. No. 4,070,268, U.S. Pat. No. 4,119,524, U.S. Pat. No. 4,164,466 and U.S. Pat. No. 4,162,956 processes are disclosed in which the heavy phase of insoluble coal products and solvent is withdrawn from a separation vessel and flashed to recover the solvent from the insoluble coal products. During the flashing, a substantial portion of the solvent is caused to vaporized and separate from the insoluble coal products, however, some solvent remains in association with the insoluble coal products. To provide an economical process, it is desirable to recover the remaining solvent from the insoluble coal products for reuse in the process.

SUMMARY OF THE INVENTION

In the process of the present invention, coal liquefaction products resulting from the hydroconversion of coal are contacted with one or more solvents under conditions of elevated temperature and pressure effective to separate the coal liquefaction products into at least two phases. More particularly, the coal liquefaction products and solvent are introduced into a separation zone in which they are caused under high temperature and pressure, to separate into a light phase comprising soluble coal products in admixture with solvent and a heavy phase comprising insoluble coal products in admixture with some solvent. The high temperature and pressure heavy phase then is withdrawn from the separation zone and introduced into a mixing zone. A cooled slurry of makeup liquid such as water and insoluble coal products then is introduced into the mixing zone in sufficient quantity to reduce the vapor pressure of the heavy phase and provide a diluted heavy phase slurry. The diluted heavy phase slurry then is reduced in pressure and introduced into a treatment zone comprising at least one substantially slurry filled treatment vessel. The diluted heavy phase slurry is introduced into the lower portion of the vessel. The treatment vessel contains sufficient slurry to provide a hydrostatic pressure sufficient to prevent boiling of the diluted slurry upon introduction therein. The diluted slurry, having an average temperature above that of the slurry present in the treatment vessel, rises within the treatment vessel and the solvent flashes as the hydrostatic pressure is reduced. The flashing cools the temperature of the diluted slurry. The temperature level in the treatment vessel is maintained slightly above the azeotrope temperature (temperature at which two solvent phases can be present) to ensure solvent flashing. The temperature control is provided by the addition of steam, as necessary.

The separated solvent and steam are withdrawn from the first treatment vessel and condensed. The condensed solvent is separated from the water and recycled in the process.

A portion of the cooled slurry of water and insoluble coal products is withdrawn from the treatment vessel and introduced into a thickener vessel. At least another portion of the slurry of water and insoluble coal products, either before or after withdrawal of the other portion from the treatment vessel, is recycled to the mixing zone.

In the thickener, the portion of cooled slurry is concentrated to a level in excess of 40 percent solids to provide a feed suitable for a gasifier or other process vessel. The separated water is recycled in the process.

DESCRIPTION OF THE PREFERRED EMBODIMENT

Figure 1:
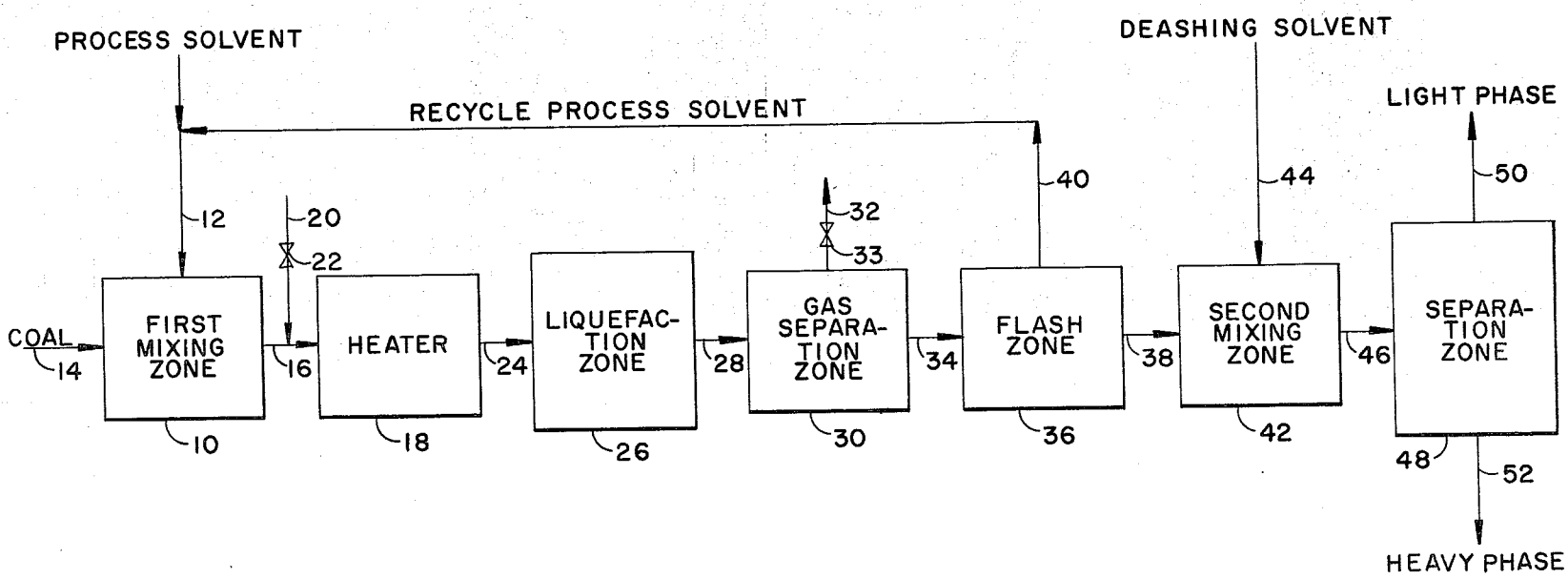
FIG. 1 is a diagrammatic, schematic illustration of a coal liquefaction and deashing process.

Turning now to the coal liquefaction and deashing process illustrated in FIG. 1, liquefaction process solvent is introduced from a source (not shown) through a conduit 12 into a first mixing zone 10.

Pulverized coal maintained in a coal storage vessel or the like (not shown) is passed into the first mixing zone 10 through a conduit 14 at a rate controlled by a solids feeder or the like (not shown) interposed in conduit 14.

In the first mixing zone 10, the coal and process solvent are agitated or mixed by a stirring mechanism (not shown) to form a slurry. That slurry is withdrawn from the first mixing zone 10 through a conduit 16 and pumped (pump not shown) to a heater 18 where the slurry is heated. In one preferred embodiment, gaseous hydrogen is passed from a source (not shown) through a conduit 20 connected to conduit 16, the gaseous hydrogen being mixed with the slurry flowing through conduit 16 and the resulting mixture being heated in the heater 18. A valve 22 is interposed in the conduit 20 for controlling the flow of the gaseous hydrogen to be mixed with the slurry flowing through conduit 16.

The slurry, which may include the gaseous hydrogen, is discharged from the heater 18 at a temperature of about 800° F. and passed through a conduit 24 into a liquefaction zone 26 to effect solubilization of a substantial portion of the coal. In one embodiment, the pressure level in liquefaction zone 26 is greater than about 1200 psig. and preferably in a range of from about 1200 psig to about 2000 psig.

In the liquefaction zone 26, the process solvent is contacted with the coal at an elevated liquefaction temperature and pressure for a period of time sufficient to solubilize at least a portion of the coal and produce a mixture of coal liquefaction products (comprising soluble coal products and insoluble coal products) and process solvent.

The mixture of coal liquefaction products is withdrawn from the liquefaction zone 26 and passed through a conduit 28 into a gas separation zone 30, which includes a degassing vessel or the like, wherein the mixture is degassed by permitting the excess hydrogen, other gases and vapors to be discharged through a conduit 32, a valve 33 being interposed in conduit 32 to control the discharge. In some operational embodiments, the hydrogen-containing gases are discharged through conduit 32 and passed to a hydrogen recycle system (not shown) for re-use in the process. In one embodiment, the temperature level of the mixture in the gas separation zone 30 is about 800° F. and the pressure level is in the range of from about 1200 psig. to about 1500 psig.

The degassed mixture is discharged from gas separation zone 30 and passed through a conduit 34 into a flash zone 36, which includes a flash vessel, an atmospheric or vacuum distillation vessel or the like (not shown). In flash zone 36, the mixture discharged from the gas separation zone 30, which includes soluble coal products and insoluble coal products is separated to produce one stream comprising coal liquefaction products which is passed from the first flash zone 36 through a conduit 38 and another stream comprising process solvent which is passed through a conduit 40 back to conduit 12 for re-use in the system.

In the operational embodiment referred to above, the pressure level in flash zone 36 is less than about 20 psig. In one preferred operation of the process, the temperature in flash zone 36 is maintained below about 650° F.

The coal liquefaction process hereinbefore described has been cited merely to illustrate one means of coal conversion and it therefore is not intended to limit the scope of the present invention to that particular means. The process of the present invention would be equally applicable to any other technique which yields coal liquefaction products.

The coal liquefaction products comprising soluble coal products and insoluble coal products are introduced into a second mixing zone 42 wherein they are admixed with a deashing solvent to form a feed mixture. The deashing solvent enters second mixing zone 42 through a conduit 44. The deashing solvent is present in a ratio of solvent to coal liquefaction products in the range of from about 1:1 to about 10:1. Larger quantities of deashing solvent can be used, but such quantities are not required.

The term "soluble coal products" means the constituents in the coal which are soluble in the deashing solvent under the process conditions.

The term "insoluble coal products" means the undissolved coal, mineral matter, other solid inorganic particulate matter and other such matter which is insoluble in the deashing solvent under the process conditions.

The term "deashing solvent" means at least one substance having a critical temperature below 800° F. selected from the group consisting of: aromatic hydrocarbons having a single benzene nucleus and normal boiling points below about 310° F., such as benzene, toluene, o-, m- and p-xylene, ethyl benzene, isopropyl benzene and monocyclic aromatic hydrocarbons in general having normal boiling points below about 310° F.; cycloparaffin hydrocarbons having normal boiling points below about 310° F., such as cyclobutane, cyclopentane, cyclohexane, cycloheptane and nonaromatic monocyclic hydrocarbons in general having normal boiling points below about 310° F.; open chain monoolefin hydrocarbons having normal boiling points below about 310° F., such as butene, pentene, hexene and heptene; open chain saturated hydrocarbons having normal boiling points below about 310° F., such as pentane, hexane and heptane; mono-, di, and tri-open chain amines containing from about 2–8 carbon atoms, such as ethyl, propyl, butyl, pentyl, hexyl, heptyl, and octyl amines; carbocyclic amines having a monocyclic structure containing from about 6–9 carbon atoms, such as aniline and its alkyl homologs; heterocyclic amines containing from about 5–9 carbon atoms, such as pyridine and its alkyl homologs; and phenols containing from about 6–9 carbon atoms and their homologs.

The feed mixture then is introduced into a separation zone 48 through a conduit 46. Separation zone 48 is maintained at a temperature level in the range of from about 400° F. to about 700° F. and a pressure level in the range of from about 600 psig. to about 1500 psig. to effect a separation of the feed mixture.

In separation zone 48 the feed mixture separates into a light phase comprising soluble coal products and deashing solvent and a heavy phase comprising insoluble coal products and some deashing solvent.

The light phase is withdrawn from separation zone 48 through a conduit 50 for further downstream processing (not shown).

Figure 2:
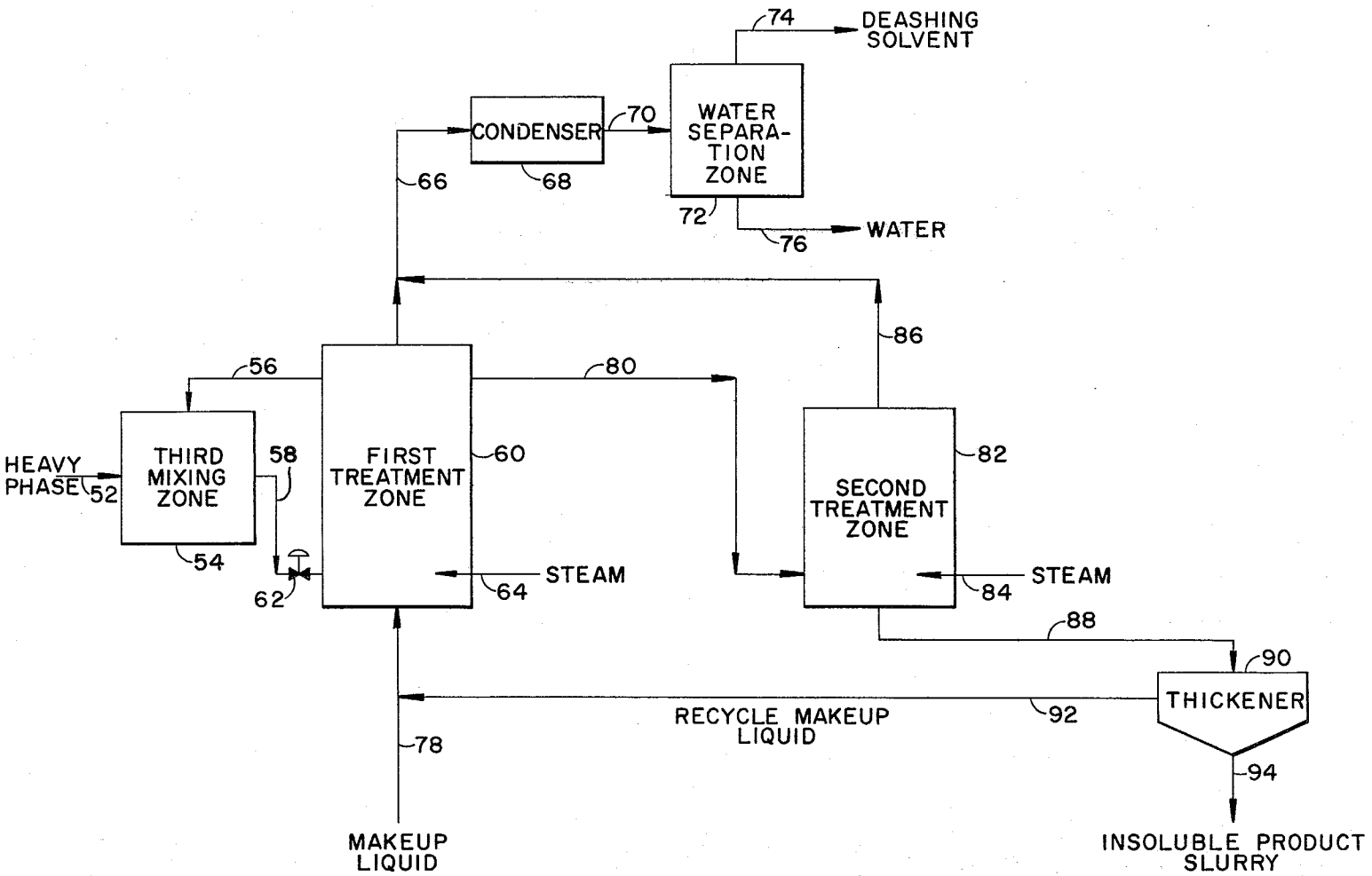
FIG. 2 is a diagrammatic, schematic illustration of the process of this invention.

The heavy phase is withdrawn from separation zone 48 through a conduit 52 and introduced into a third mixing zone 54 (see FIG. 2).

Turning now to FIG. 2, the heavy phase, still under high temperature and pressure, is admixed with a cooled slurry of insoluble coal products and a makeup liquid in the third mixing zone 54. To facilitate an understanding of the process of the present invention, and not by way of limitation, hereinafter specific reference will be made to a makeup liquid comprising water. The makeup liquid can comprise any fluid which is inert with respect to the coal liquefaction products and deashing solvent. The cooled slurry is introduced into the third mixing zone through a conduit 56. Sufficient cooled slurry is provided to reduce the vapor pressure of the heavy phase within the mixing zone and provide a diluted heavy phase slurry. Preferably, the vapor pressure of the heavy phase is reduced to a level in the range of from about 1 to about 5 atmospheres and most preferably from about 1 to about 3 atmospheres. The heavy phase is at least partially cooled by admixing with the cooled slurry while substantially maintaining its original pressure. The diluted heavy phase slurry is withdrawn from third mixing zone 54 through a conduit 58, reduced in pressure by passage through a pressure reduction valve 62 interposed in conduit 58 and introduced into a first treatment zone 60. The pressure level of the diluted heavy phase preferably is reduced to a level in the range of from about 15 to about 50 psig. The deashing solvent in the heavy phase remains substantially liquid during the pressure reduction; no significant deashing solvent flashing occurs during the pressure reduction.

While not required, a surfactant can be added, if desired, to the diluted heavy phase to improve its fluid properties.

Preferably, the surfactant is comprised of at least one compound having a straight or branched long chain hydrocarbon group and an anionic, nonionic or cationic group. The anionic group is one selected from the group consisting of a carboxylic acid salt group, a sulfonate salt group, a sulfate group or a phosphate group. The nonionic group is one selected from the group consisting of ethers, hydroxyls, esters and amides. The cationic group is one selected from the group consisting of amines and quaternary ammonium salts. A particular anionic surfactant which was found suitable for use is a polyfunctional compound identified as "Polywet Oligomeric Surfactant" and is available commercially from Uniroyal Chemical, Naugatuck, Connecticut, such surfactant being designated as "POLYWET ® KX-3," for example. Another anionic surfactant which is suitable for use is identified as "LOMAR PW" and is available commercially from Diamond Shamrock Corporation, Morristown, N.J., for example.

First treatment zone 60 comprises at least one treatment vessel which contains slurry of sufficient depth to provide a hydrostatic pressure in the region where the diluted heavy phase is introduced into the treatment zone 60 sufficient to prevent spontaneous boiling of the deashing solvent. As the diluted heavy phase is introduced into first treatment zone 60, it displaces the diluted heavy phase previously introduced and causes the displaced diluted heavy phase to rise within zone 60. As the diluted heavy phase rises, the hydrostatic pressure is reduced and at least a portion of the deashing solvent and water flash from the heavy phase. The flashing of the solvent and water cools the remaining slurry. The treatment zone is maintained at a temperature level above the azeotrope temperature of the mixture to ensure that at least a portion of the deashing solvent and make up water vaporizes. The temperature control is effected by the introduction of steam into first treatment zone 60 through a conduit 64.

The vaporized deashing solvent and steam pass from first treatment zone 60 through a conduit 66 and is introduced into a condenser 68. The vaporized deashing solvent and steam condense within condenser 68 to provide a water-solvent stream. The water-solvent stream is withdrawn from condenser 68 through a conduit 70 and introduced into a water separation zone 72. Water separation zone 72 comprises any of the type vessels known by those skilled in the art as suitable for separating water from an immiscible fluid. The deashing solvent separated in water separation zone 72 is withdrawn through a conduit 74 for recycle to second mixing zone 42 to provide at least a portion of the deashing solvent necessary for the preparation of the feed mixture formed therein. The water separated in zone 72 is withdrawn through a conduit 76 for disposal or as a supply of make-up water for other processes.

At least a portion of the slurry contained in first treatment zone 60 is withdrawn through conduit 56 to provide the cool slurry introduced into the third mixing zone 54. Water for formation of the original slurry and to provide for process losses is introduced into zone 60 through a conduit 78.

In an alternate embodiment of the invention, the water can be introduced into conduit 56, conduit 58 either before or after pressure reduction, or directly into third mixing zone 54. Sufficient water should be present to dilute the mixture of insoluble coal products and deashing solvent to a level of from about 5 percent to about 50 percent solids, by weight.

Applicant has found that the deashing solvent is associated with the insoluble coal products of the heavy phase in two ways; (1) as liquid deashing solvent in contact with the insoluble coal products and (2) deashing solvent which has infused into the particles comprising the insoluble coal products. While the liquid deashing solvent in contact with the insoluble coal products comprises a substantial portion of the total deashing solvent, it also is desirable to recover at least a portion of the infused deashing solvent. The flashing in first treatment zone 60 fails to remove the infused deashing solvent from the particles of insoluble coal products. Applicant has found that when the insoluble coal products are maintained in an environment of reduced deashing solvent concentration, the deashing solvent will diffuse to the surface of the particles of insoluble coal products at a rate in accordance with the following equation:

$$(dC)/(dt) = -k'C$$

where C corresponds to the percent of deashing solvent in the particles at time t and t is the time in minutes from the start of diffusion.

To effect the recovery of at least a portion of the infused deashing solvent, a second portion of the slurry in first treatment zone 60 is withdrawn through a conduit 80 and introduced into a second treatment zone 82. Second treatment zone 82 can comprise one or more vessels of appropriate size to permit a residence time sufficient for diffusion of at least a portion of the infused deashing solvent to occur. To maintain the concentration of deashing solvent sufficiently low within second treatment zone 82 to facilitate the diffusion process, steam is introduced into a lower portion of zone 82 through a conduit 84. The steam flows by the particles of insoluble coal products in the slurry and continuously sweeps any diffused deashing solvent away from the particles. The steam and diffused deashing solvent are withdrawn from second treatment zone 82 through a conduit 86. Advantageously, conduit 86 connects to conduit 66 to permit the steam and deashing solvent to be introduced into condenser 68 for recovery. Alternatively, a separate condenser and water separation zone (not shown) can be provided to effect recovery of the deashing solvent withdrawn from second treatment zone 82.

The residue remaining in second treatment zone 82 is withdrawn through a conduit 88 and introduced into a thickener 90. Thickener 90 is operated so as to concentrate the slurry of insoluble coal products to a level in excess of 40 percent solids and preferably a level in excess of 50 percent solids. The water separated from the slurry in thickener 90 is withdrawn through a conduit 92 for recycle in the process. The concentrated insoluble coal product slurry is withdrawn from thickener 90 through a conduit 94. The concentrated insoluble coal product slurry can be introduced as feed into a gasifier (not shown) or other process vessel for further treatment.

To further illustrate the process of this invention, and not by way of limitation, the following example is provided.

EXAMPLE

A mixture of soluble and insoluble coal products produced by the process hereinbefore described is admixed with a deashing solvent comprising benzene in a ratio by weight of coal liquefaction products to benzene of 1:3 to form a feed mixture. The feed mixture then is introduced into separation zone 48. Separation zone 48 is maintained at a temperature level of about 525° F. and a pressure level of about 800 psig. to cause the feed mixture to separate into a light phase and a heavy phase comprising insoluble coal products and some benzene. The benzene comprises about 15 percent of the heavy phase.

The heavy phase is withdrawn from separation zone 48 and introduced into mixing zone 54 to contact a cooled slurry of water and insoluble coal products. The cooled slurry is at a temperature of about 184° F. Sufficient cooled slurry is present to dilute the solids concentration of the mixture to a level of about 25 percent by weight, thereby reducing the vapor pressure of the heavy phase to less than about 5 atmospheres. The diluted heavy phase then is reduced in pressure by passage through pressure reduction valve 62 and introduced into the bottom of first treatment zone 60. The surface of the slurry in treatment zone 60 is maintained at a pressure level of about one atmosphere, and the depth of the slurry is sufficient to prevent flashing of the feed as it enters the bottom of treatment zone 60. The temperature of the diluted heavy phase is about 220° F. upon introduction into treatment zone 60. As the diluted heavy phase mixes within treatment zone 60, at least a portion of the diluted heavy phase rises in treatment zone 60 because of the temperature of the diluted heavy phase. As the diluted heavy phase rises, a portion of the benzene and water present therein is vaporized by spontaneous flashing.

A portion of the slurry then is withdrawn and introduced into second treatment zone 82 wherein it is contacted with steam. Benzene diffuses from the insoluble coal product particles and is swept away by the steam.

The vaporized benzene and steam are withdrawn from treatment zone 60 and zone 82 through conduits 66 and 86, respectively, and introduced into condenser 68. The condensed benzene and water is introduced into water separation zone 72. The benzene separated in zone 72 is recycled to mix with additional coal liquefaction products and the water is sewered or recycled in the process.

The slurry remaining in treatment zone 82 is withdrawn and introduced into a thickener 90 wherein it is concentrated to a solids level of about 50 percent to provide a feed which is suitable for a gasifier. The insoluble coal products now contain less than 0.4 weight present of benzene.

While the present invention has been described with respect to what at present is the preferred embodiment, it is understood, of course, that certain changes, substitutions, modifications and the like may be made therein without departing from its true scope as defined in the appended claims.

What is claimed is:

1. A process comprising:

providing coal liquefaction products comprising soluble coal products and insoluble coal products;

contacting said coal liquefaction products with a deashing solvent to provide a feed mixture;

introducing said feed mixture into a separation zone maintained at an elevated temperature and pressure level to effect a separation of said feed mixture into a light phase and a heavy phase comprising insoluble coal products and deashing solvent;

contacting said heavy phase with a recycled cool slurry comprising insoluble coal products and water in a sufficient quantity to reduce the vapor pressure of said heavy phase and to provide a diluted heavy phase;

reducing the elevated pressure level of said diluted heavy phase;

introducing the reduced pressure diluted heavy phase into a first treatment zone maintained under conditions such that at least a portion of the deashing solvent contained in said diluted heavy phase is vaporized, said vaporization resulting in cooling of said diluted heavy phase to form a cooled slurry;

introducing makeup water into said first treatment zone to admix with the heavy phase to effect formation of the slurry present therein;

withdrawing a portion of said cooled slurry to provide said recycle cool slurry which is contacted with said heavy phase;

withdrawing another portion of said cooled slurry and introducing said withdrawn portion into a second treatment zone, said second treatment zone maintained under conditions such that at least a portion of any deashing solvent infused in the insoluble coal products is caused to diffuse therefrom as vaporized deashing solvent;

withdrawing vaporized deashing solvent from said first and second treatment zones;

condensing said vaporized deashing solvent for recycle to provide at least a portion of said deashing solvent present in said feed mixture; and withdrawing said remaining slurry from said second treatment zone.

2. The process of claim 1 wherein said separation zone is maintained at a temperature level in the range of from about 400° F. to about 700° F. and a pressure level in the range of from about 600 psig. to about 1500 psig.

3. The process of claim 1 wherein the vapor pressure of the heavy phase is reduced to a level in the range of from about 1 to about 5 atmospheres.

4. A process comprising:

providing an elevated temperature and pressure feed mixture comprising insoluble coal products and deashing solvent;

mixing said feed mixture with a recycled slurry of a makeup liquid and insoluble coal products in a sufficient quantity to reduce the vapor pressure of said feed mixture and to provide a diluted mixture;

reducing the pressure on said diluted mixture;

introducing said diluted mixture into a first treatment zone maintained under conditions such that at least a portion of the deashing solvent contained in said diluted mixture is vaporized, said vaporization cooling the remainder of said diluted mixture;

mixing said diluted mixture with said makeup liquid to form a slurry;

recycling a first portion of said slurry to provide said recycled slurry;

withdrawing vaporized deashing solvent from said first treatment zone;

introducing a second portion of said cooled slurry into a second treatment zone wherein at least a portion of any deashing solvent infused in said insoluble coal products is caused to diffuse therefrom to provide a substantially deashing solvent-free slurry of insoluble coal products;

withdrawing diffused deashing solvent from said second treatment zone; and recovering said withdrawn vaporized and diffused deashing solvent.

5. The process of claim 4 further comprising the step of:

concentrating the substantially deashing solvent-free slurry of insoluble coal products by removing a substantial portion of said makeup liquid to produce a low pressure concentrated slurry of insoluble coal products.

6. In the deashing of coal in which insoluble coal products are removed by liquefying the coal in a solvent to form coal liquefaction products comprising soluble coal products and insoluble coal products, and effecting phase separation of the coal liquefaction products through the use of a deashing solvent under conditions of elevated temperature and pressure to produce a light phase and a heavy phase, said light phase comprising soluble coal products and deashing solvent and said heavy phase comprising insoluble coal products and some deashing solvent, the improvements which comprise:

mixing a makeup liquid with said heavy phase in a sufficient quantity to reduce the vapor pressure of said heavy phase and to form a diluted heavy phase;

reducing the pressure level of said diluted heavy phase;

introducing said reduced pressure diluted heavy phase into a first treatment zone maintained under conditions such that at least a portion of the deashing solvent in said heavy phase is vaporized, said vaporization resulting in cooling of the remainder to form a cooled slurry of insoluble coal products containing infused deashing solvent and makeup liquid;

recovering said vaporized deashing solvent;

recycling a first portion of said cooled slurry to provide at least a portion of the makeup liquid necessary to dilute the heavy phase;

introducing a second portion of said cooled slurry into a second treatment zone maintained under conditions such that infused deashing solvent is caused to diffused from said insoluble coal products to provide a substantially deashing solvent-free slurry of insoluble coal products in makeup liquid; and recovering diffused deashing solvent from said second separation zone.

7. The process of claim 6 further comprising the step of:

concentrating the substantially deashing solvent-free slurry of insoluble coal products by removing a substantial portion of said makeup liquid to produce a low pressure concentrated slurry of insoluble coal products.

8. The process of claim 6 wherein the reduced pressure is approximately atmospheric pressure.

9. The process of claim 6 wherein the makeup liquid is water.

10. The process of claim 6 wherein introduction of the reduced pressure diluted heavy phase into the first treatment zone is defined further as:

introducing said reduced pressure diluted heavy phase into a lower portion of a first treatment zone containing a cooled slurry of insoluble coal products containing infused deashing solvent and makeup liquid, the hydrostatic pressure exerted by said cooled slurry upon said reduced pressure diluted heavy phase being sufficient to prevent spontaneous flashing of the solvent present in said reduced pressure diluted heavy phase upon introduction into said lower portion of said first treatment zone, and thereafter admixing said reduced pressure diluted heavy phase with said cooled slurry within said first treatment zone under conditions such that at least a portion of the deashing solvent contained in said reduced pressure diluted heavy phase is vaporized, said vaporization resulting in cooling of said reduced pressure diluted heavy phase to form an additional quantity of said cooled slurry.

* * * * *